United States Patent [19]

Larsen

[11] 4,296,701

[45] Oct. 27, 1981

[54] THREADING ARRANGEMENT FOR CHAINSTITCH SEWING ON A SEWING MACHINE

[75] Inventor: Robert H. Larsen, Middletown, N.J.

[73] Assignee: The Singer Company, Stamford, Conn.

[21] Appl. No.: 204,420

[22] Filed: Nov. 6, 1980

[51] Int. Cl.[3] ..... D05B 1/14

[52] U.S. Cl. ..... 112/168; 112/181; 112/197; 112/259; 112/302

[58] Field of Search ..... 112/168, 181, 197, 302, 112/258, 253, 246

[56] References Cited

U.S. PATENT DOCUMENTS 3,194,197 7/1965 Ketterer et al. ..... 112/168

3,789,784 2/1974 Hanyu et al. ..... 112/246

FOREIGN PATENT DOCUMENTS 48-10657 2/1973 Japan .

53-28603 7/1978 Japan .

*Primary Examiner*—H. Hampton Hunter

*Attorney, Agent, or Firm*—William V. Ebs; Robert E. Smith; Edward L. Bell

[57] ABSTRACT

A chainstitch thread guide is formed with a thread guiding trough which extends into a channel on one side of a partitioning wall in a sewing machine to receive needle thread extending upwardly from a tensioning device to a take-up lever and further receives such needle thread extending downwardly from the take-up lever on the way to a sewing needle.

9 Claims, 7 Drawing Figures

THREADING ARRANGEMENT FOR CHAINSTITCH SEWING ON A SEWING MACHINE

BACKGROUND OF THE INVENTION

1. Field of the Invention

The invention relates to threading arrangements for chainstitch sewing on a sewing machine.

2. Description of the Prior Art

It is well known, that when a sewing machine is to be used for chainstitching, less needle thread must be supplied to the needle than for lockstitching, and that if the amount of thread supplied to the needle is not reduced, improper stitches will be formed. It has been a common practice to provide machines with a special thread guide between a lower positioned thread hook guide and a thread take-up lever, which guide, if used during chainstitching, effected the required reduction in thread supplied to the needle. Such special thread guides required a machine to be threaded one way for chainstitching and another way for lockstitching. However, it was easy for an operator by mistake to thread a machine for lockstitching when it should have been threaded for chainstitching, and when switching from a chainstitching mode to a lockstitching mode to leave a machine threaded for chainstitching. In either event, faulty stitches were produced.

It is a primary object of the present invention to enable a sewing machine to be threaded in the same manner with needle thread for chainstitching and lockstitching.

It is another object of the invention to provide a sewing machine with an easily attachable and detachable chainstitching thread guide which enables the machine to be threaded in the same manner with needle thread whether the guide is in use on the machine or detached from it.

Other objects and advantages of the invention will become apparent hereinafter.

SUMMARY OF THE INVENTION

A lockstitch sewing machine having a partitioning wall in a bracket arm between thread receiving channels, wherein needle thread extends down one of said channels, around the bottom edge of the partition wall and into the other channel, upwardly through a check spring to a take-up lever, and downwardly from the take-up lever in said other channel on the way to a sewing needle, is provided with a chainstitch thread guide which includes a thread guiding trough extending into said other channel. The chainstitching thread guide receives needle thread in said trough extending from the tensioning device up to the take-up lever and from the take-up lever downwardly on the way to the needle. The inner end of the trough is located to decrease the amount of slack thread made available for sewing instrumentalities of the machine by downward movement of the take-up lever.

DESCRIPTION OF THE PREFERRED EMBODIMENT

Figure 1:
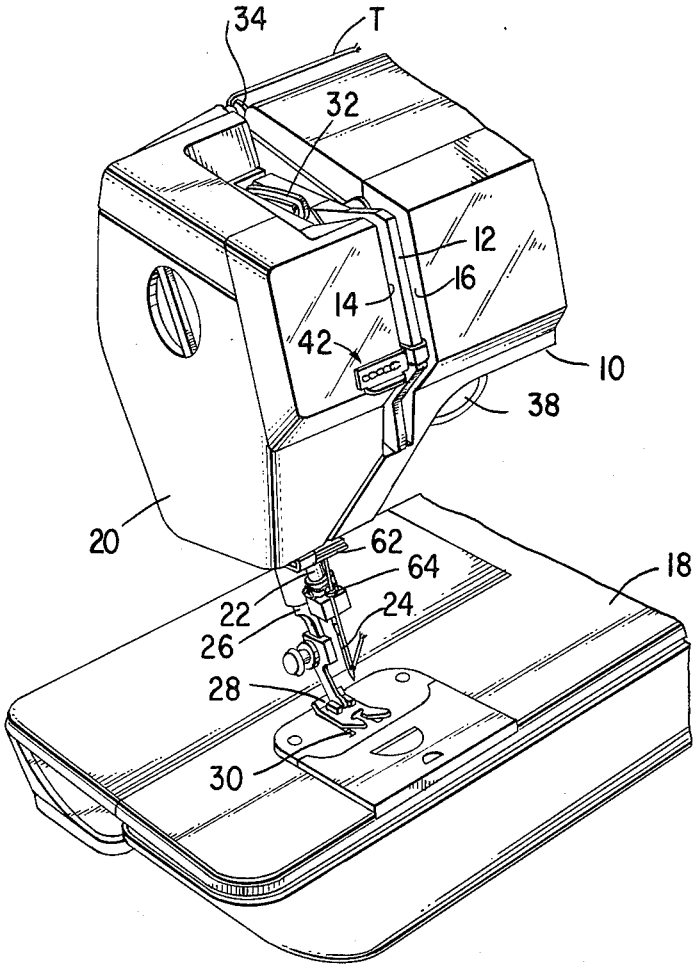
FIG. 1 is a perspective view of a head end portion of a sewing machine equipped with a chainstitch thread guide according to the invention.
Figure 3:
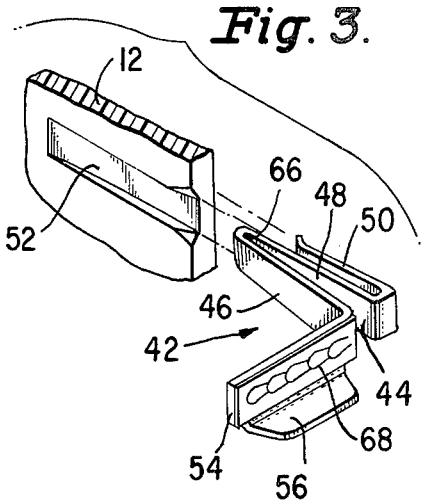
FIG. 3 is an enlarged perspective showing the chainstitch thread guide and a portion of a partition wall to which the guide attaches.
Figure 2:
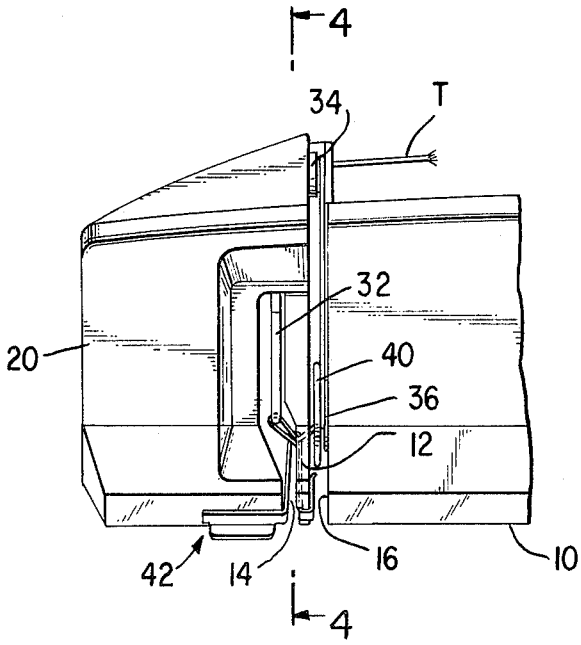
FIG. 2 is a top plan view of the head end portion of the machine with the chainstitch thread guide thereon.
Figure 4:
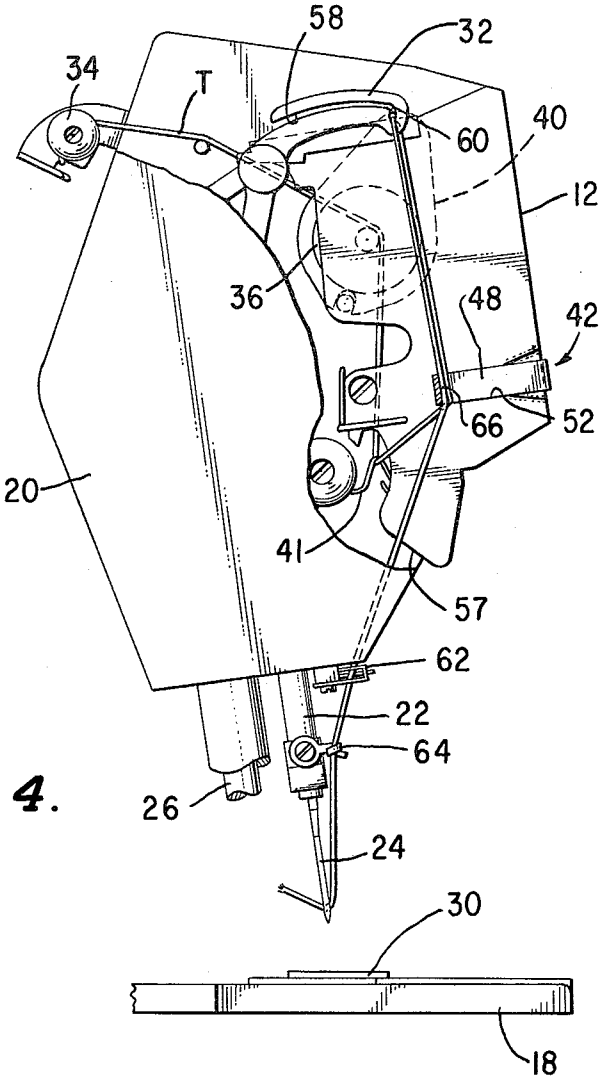
FIG. 4 is a view taken on the plane of the line 4—4 of FIG. 2 and showing the chainstitching thread path through the machine with the take-up lever in its extreme thread pulling position.
Figure 5:
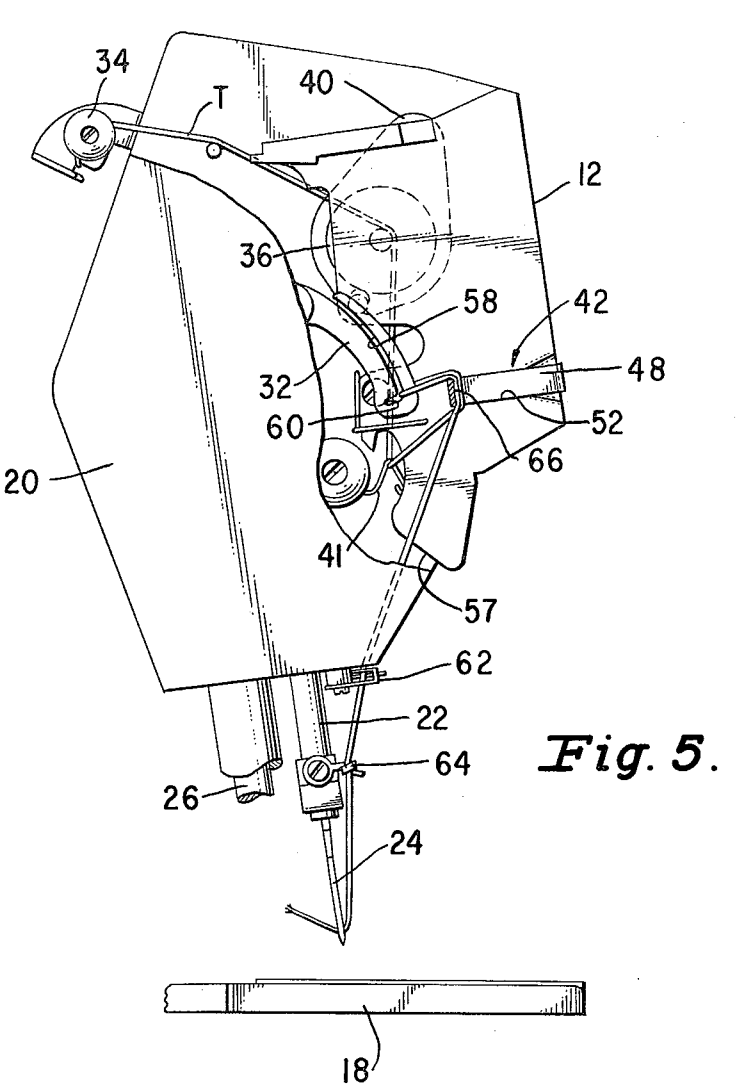
FIG. 5 is a view similar to FIG. 4 showing the chainstitching thread path through the machine with the take-up lever in the extreme thread supplying position.

Referring to the drawings, reference character 10 designates the bracket arm of a lockstitch sewing machine including a partitioning wall 12 between thread receiving channels 14 and 16. The bracket arm overhangs a bed 18 and includes a head end portion 20 which carries an endwise reciprocatory needle bar 22 having a sewing needle 24 removably attached to the lower end thereof. Also carried within the head end portion 20 of the bracket arm is a downwardly biased presser bar 26 having a presser foot 28 attached thereto for urging a material being sewn into engagement with a feed dog 30 driven by a feed mechanism (not shown).

Needle 24 is one of the stitch forming instrumentalities of the machine. A loop taker of conventional construction which is another of the stitch forming instrumentalities and which is provided in the bed 12 but not shown, cooperates with the needle as the needle is reciprocated in timed relation to rotation of the loop taker. During the operation of the machine, it is the function of the needle 24 to carry loops of thread through a work fabric and to present such loops to the loop taker for concatenation into stitches. A take-up lever 32 serves to pay out slack thread to accommodate reciprocation of the needle and manipulation of needle thread engaged by the loop taker, and then to draw up the slack thread into a stitch in the work fabric.

The machine includes a pretension guide 34, a thread tensioner 36 adjustable with a dial 38, a thread introduction plate 40 for the thread tensioner, and a check spring 41, all of which are conventional in design. Reference character 42 designates a chainstitch thread guide constructed according to the invention and shown attached to partitioning wall 12 in FIGS. 1, 2, 4 and 5. The thread guide which is preferably formed as an integral unit of sheet steel or other resilient material, includes a thread receiving trough 44 defined by spaced elongate walls 46 and 48. A portion of the wall 48 and a reverse extension 50 thereof serve as a spring clip for securing the guide to partitioning wall 12 wherein the wall 48 is received in a groove 52. The guide further includes an elongate front flange 54 which extends substantially perpendicular to wall 46, and has a perpendicular finger engagable tab 56 thereon which an operator can use to attach the guide to the partitioning wall 12 or to remove the guide from the machine.

Figure 7:
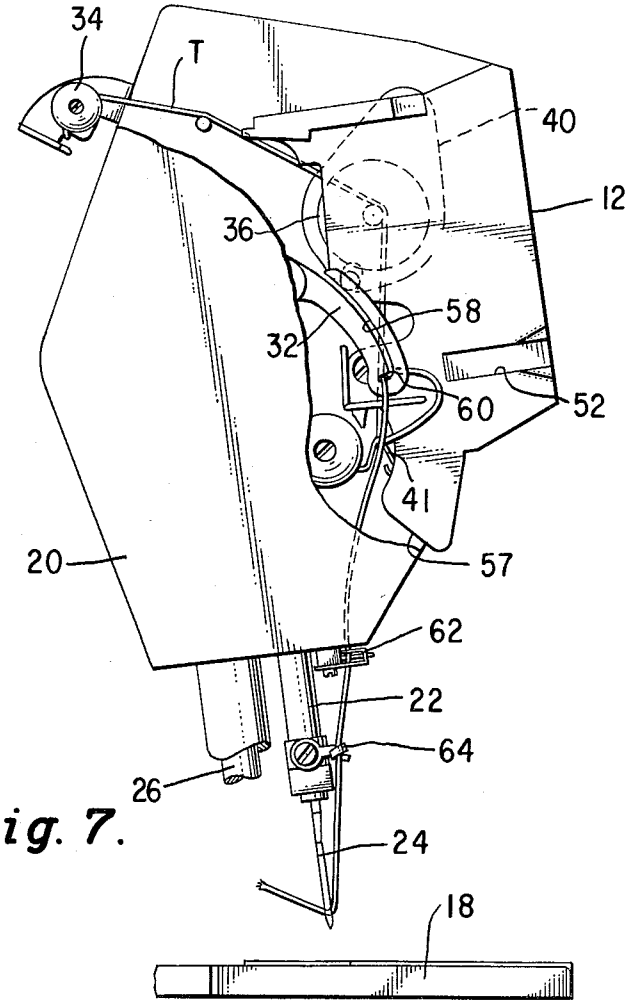
FIG. 7 is a view similar to FIG. 6 showing the thread path through the machine for lockstitching when the take-up lever is in the extreme thread supplying position.
Figure 6:
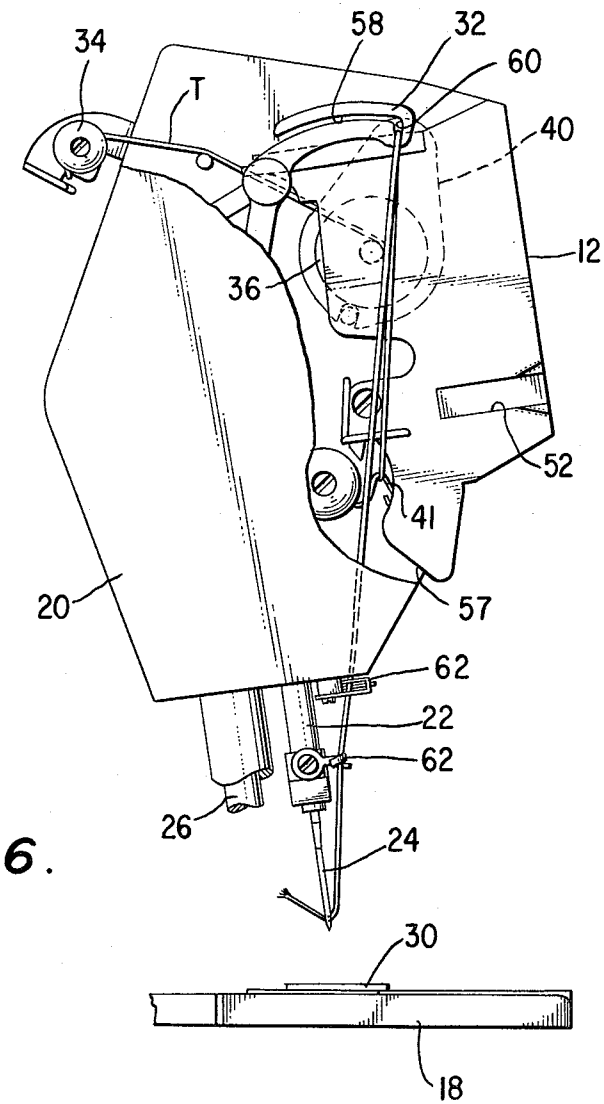
FIG. 6 is a view similar to FIGS. 4 and 5 showing the thread path through the machine for lockstitching when the take-up lever is in the extreme thread pulling position.

An operator threads the machine with needle thread T in the same manner whether the thread guide 42 is on the machine (FIGS. 4 and 5), or off the machine (FIGS. 6 and 7). The thread is first led from a source of supply (not shown) to pretension guide 34. The thread is then led through tensioner 36 and down channel 16. The thread is further led around lower edge 57 of the partitioning wall 12 to the other channel 14 and caused to engage check spring 41 as it is led upwardly to take-up lever 32 where it is directed through thread introduction groove 58 to eyelet 60. From the take-up lever the thread is led downwardly and through a snubber 62 and guide 64 to the needle 24. With the chainstitch thread guide 42 in place on the machine the needle thread T is caused to pass through the trough 44 of the guide as the thread is led upwardly to the take-up lever 40 and also as it is led downwardly therefrom.

The chainstitch thread guide attaches to wall 12 at a height which is above that of the check spring 41 but below the thread holding eyelet 60 of lever 32 throughout most of the lever's movement; and in such attached position of the guide, the inner end 66 of trough 44 serves to hold the thread outwardly from the check spring and take-up lever. Chainstitches are formed on the machine with the thread guide 42 in place on the partition wall 12, a bobbin case thread directing plate as described for example, in U.S. Pat. No. 3,194,197 for "Chain Stitch Device for Lock Stitch Sewing Machine" substituted for a conventional bobbin, and a throat plate as described in such patent substituted for a conventional throat plate. The chainstitch guide effects a reduction in the amount of thread supplied to the needle and loop taker by movement of the take-up lever 40 from an extreme upward position (FIG. 4) to its lowest portion (FIG. 5); that is, less thread is supplied for concatenation by the loop taker than would be supplied in the absence of the guide (compare FIGS. 4 and 5 with FIGS. 6 and 7). The chainstitch guide results in an insufficient amount of thread being supplied to meet loop taker demand, and the insufficiency is supplied by a previously held loop. The loop taker sets a chainstitch during the expansion of each new thread loop thereby and prior to upward movement by the take-up lever as described in the aforesaid U.S. Pat. No. 3,194,197. As a result the stitches are set without undue tension and there is an absence during a greater part of the stitch cycle of loose thread loops which could otherwise become caught and elongated in the bed.

It is a particular advantage of the invention that the chainstitch thread guide 42 is easily attached to or removed from the machine, and that it enables the machine to be threaded in precisely the same way whether the guide is on the machine or not. Normally, the guide would be off the machine and the machine would be threaded, as described, through channels 14 and 16 for lockstitching. With the guide in place, the machine is threaded in the same manner as for chainstitching. There is no permanently affixed chainstitch guide on the machine for an operator to thread by mistake as he prepares the machine for lockstitching, or from which the thread would have to be removed when switching from lockstitching to chainstitching. Although thread guide 42 has to be removed from the machine when changing from a chainstitching to a lockstitching operation, the necessity of doing so is apparent to even the most inexperienced operator because of the obvious purpose of the guide, a purpose which is emphasized by information in the form of a chainstitch illustration 68 carried on the front flange 54 of the guide.

While the present disclosure is of a preferred embodiment of the invention, it is for purposes of illustration only, and is not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine which includes a partitioning wall in a bracket arm between thread receiving channels, and wherein needle thread extends down one of said channels, around the bottom edge of the partition wall and into the other channel, upwardly through a check spring to a movable thread pulling and thread supplying take-up lever, and downwardly from the take-up lever on the way to a sewing needle; a chainstitch thread guide attached to the partitioning wall and including a thread guiding trough extending into said other channel to receive the needle thread extending from the check spring to the take-up lever and the thread extending downwardly from the take-up lever on the way to the needle, the inner end of the trough being located to decrease the thread supplying capability of the take-up lever.

2. The combination of claim 1 wherein the chainstitch guide is removably attached to the partitioning wall.

3. The combination of claim 2 wherein the guide includes an information carrying flange which extends outside the channels in a direction substantially perpendicular thereto.

4. The combination of claim 2 wherein the guide includes a tab which is outside the channels and which an operator can grasp and use to pull the guide from the machine.

5. The combination of claim 2 wherein the guide includes an information carrying flange which extends outside the channels and the flange is provided with a tab which an operator can grasp and use to pull the guide from the machine.

6. The combination of claim 5 wherein the flange extends perpendicular to the channels and the tab is substantially perpendicular to the flange.

7. The combination of claim 2 wherein the guide is attached to the partitioning wall with resilient spaced apart wall engaging portions.

8. The combination of claim 7 wherein there is a groove on at least one side of said partitioning wall and one of said spaced apart portions of the guide is received in such groove.

9. The combination of claim 7 wherein the guide includes an information carrying flange which extends outside the channels; the flange is provided with a tab which an operator can grasp and use to pull the guide from the machine; and the spaced apart wall portions, flange and tab are integral.

* * * * *